US010871051B2

(12) United States Patent
Di Crescenzo et al.

(10) Patent No.: US 10,871,051 B2
(45) Date of Patent: Dec. 22, 2020

(54) SYSTEM AND METHOD FOR DRILLING A WELLBORE PORTION IN A SUBTERRANEAN FORMATION

(71) Applicant: SHELL OIL COMPANY, Houston, TX (US)

(72) Inventors: Daniele Di Crescenzo, New Orleans, LA (US); William Robert Portas, Gautier, MS (US)

(73) Assignee: SHELL OIL COMPANY, Houston, TX (US)

( * ) Notice: Subject to any disclaimer, the term of this patent is extended or adjusted under 35 U.S.C. 154(b) by 13 days.

(21) Appl. No.: 16/314,982

(22) PCT Filed: Jun. 30, 2017

(86) PCT No.: PCT/US2017/040240

§ 371 (c)(1),
(2) Date: Jan. 3, 2019

(87) PCT Pub. No.: WO2018/009437

PCT Pub. Date: Jan. 11, 2018

(65) Prior Publication Data

US 2019/0249518 A1 Aug. 15, 2019

Related U.S. Application Data

(60) Provisional application No. 62/358,395, filed on Jul. 5, 2016.

(51) Int. Cl.
*E21B 33/14* (2006.01)
*E21B 21/00* (2006.01)
(Continued)

(52) U.S. Cl.
CPC ..... *E21B 33/14* (2013.01); *E21B 7/20* (2013.01); *E21B 21/001* (2013.01); *E21B 21/10* (2013.01); *E21B 33/126* (2013.01); *E21B 33/143* (2013.01)

(58) Field of Classification Search
CPC ..... E21B 33/14; E21B 34/14; E21B 21/10; E21B 7/20; E21B 43/10; E21B 33/134;
(Continued)

(56) References Cited

U.S. PATENT DOCUMENTS 3,732,143 A 5/1973 Joosse
5,558,851 A 9/1996 Miller
(Continued)

FOREIGN PATENT DOCUMENTS

GB 2348223 A 9/2000

OTHER PUBLICATIONS

International Search Report and Written Opinion received for PCT Patent Application No. PCT/US2017/040240, dated Dec. 11, 2017, 13 pages.

(Continued)

*Primary Examiner* — Zakiya W Bates

(57) ABSTRACT

A portion of a wellbore is drilled in a subterranean formation, using a drilling string (140) disposed within a casing string (130) and extending through a cement retainer (150) disposed within the casing string. The drilling string can be retracted into the casing string to a location fully above the cement retainer, and subsequently the casing string can be cemented in the wellbore whereby maintaining the drilling string inside the casing in the wellbore.

10 Claims, 6 Drawing Sheets

(51) Int. Cl.
*E21B 33/126* (2006.01)
*E21B 21/10* (2006.01)
*E21B 7/20* (2006.01)

(58) Field of Classification Search
CPC .... E21B 33/143; E21B 21/103; E21B 43/103; E21B 33/13
See application file for complete search history.

(56) References Cited

U.S. PATENT DOCUMENTS

| | | | |
|---|---|---|---|
| 5,648,585 | A | 7/1997 | Murray et al. |
| 6,261,534 | B1 | 7/2001 | Miller |
| 6,632,415 | B2 | 10/2003 | Miller et al. |
| 8,916,490 | B2 | 12/2014 | Chewter et al. |
| 8,946,106 | B2 | 2/2015 | Quevedo Enriquez et al. |
| 10,150,921 | B2 | 12/2018 | Johnson et al. |
| 2004/0221997 | A1 | 11/2004 | Giroux et al. |
| 2008/0300435 | A1 | 12/2008 | Cortright et al. |
| 2009/0101345 | A1* | 4/2009 | Moffitt ..... E21B 7/20 166/285 |
| 2009/0107675 | A1 | 4/2009 | Eriksen et al. |
| 2010/0236988 | A1 | 9/2010 | Gabrielov et al. |
| 2012/0317872 | A1 | 12/2012 | Powell et al. |
| 2013/0109896 | A1 | 5/2013 | Powell et al. |
| 2013/0152457 | A1 | 6/2013 | Powell et al. |
| 2013/0152458 | A1 | 6/2013 | Powell et al. |
| 2014/0005444 | A1 | 1/2014 | Komplin et al. |
| 2014/0005445 | A1 | 1/2014 | Komplin et al. |
| 2014/0117275 | A1 | 5/2014 | Powell et al. |
| 2014/0117276 | A1 | 5/2014 | Powell et al. |
| 2014/0117277 | A1 | 5/2014 | Powell et al. |
| 2014/0121419 | A1 | 5/2014 | Powell et al. |
| 2014/0166221 | A1 | 6/2014 | Powell et al. |
| 2014/0173975 | A1 | 6/2014 | Chheda et al. |
| 2014/0174432 | A1 | 6/2014 | Powell |
| 2014/0174433 | A1 | 6/2014 | Powell |
| 2015/0166681 | A1 | 6/2015 | Chheda et al. |
| 2015/0166682 | A1 | 6/2015 | Powell et al. |
| 2015/0167235 | A1 | 6/2015 | Powell et al. |
| 2015/0167236 | A1 | 6/2015 | Powell et al. |
| 2015/0167237 | A1 | 6/2015 | Powell et al. |
| 2015/0167238 | A1 | 6/2015 | Powell et al. |
| 2015/0167239 | A1 | 6/2015 | Powell et al. |
| 2015/0167240 | A1 | 6/2015 | Powell et al. |
| 2015/0167241 | A1 | 6/2015 | Powell et al. |
| 2015/0184081 | A1 | 7/2015 | Powell et al. |
| 2017/0001933 | A1 | 1/2017 | Johnson et al. |
| 2017/0001934 | A1 | 1/2017 | Powell et al. |
| 2017/0002272 | A1 | 1/2017 | Johnson et al. |

OTHER PUBLICATIONS

Corma et al., "Processing Biomass-derived Oxygenates in the Oil Refinery: Catalytic Cracking (FCC) Reaction Pathways and Role of Catalyst", Journal of Catalysis, vol. 247, Issue No. 2, Apr. 25, 2007, pp. 307-327.

* cited by examiner

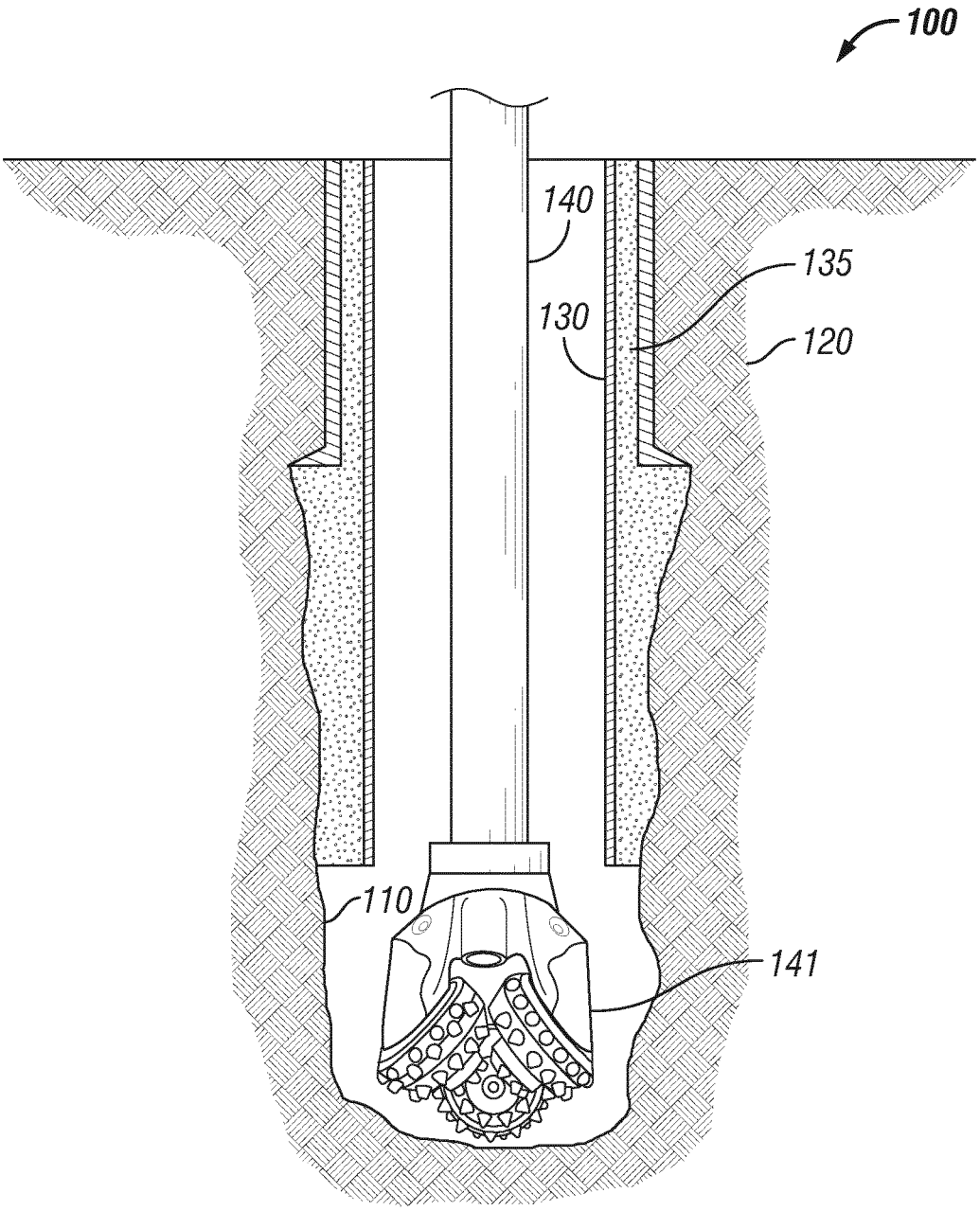
FIG. 1C
AMENDED

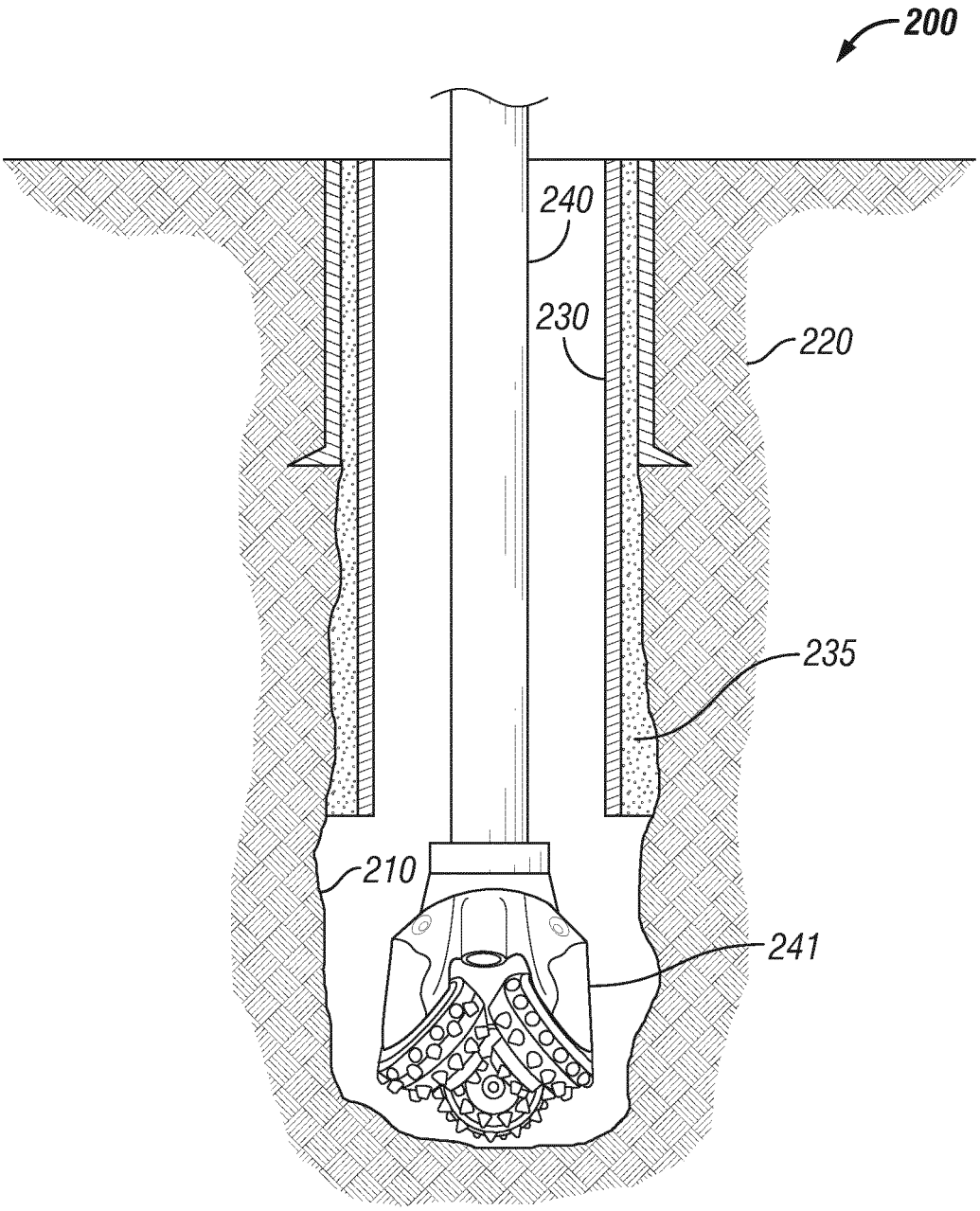
FIG. 2C
AMENDED

SYSTEM AND METHOD FOR DRILLING A WELLBORE PORTION IN A SUBTERRANEAN FORMATION

CROSS REFERENCE TO EARLIER APPLICATION

The present application is a National Stage (§ 371) application of PCT/US2017/040240, filed Jun. 30, 2017, which claims the benefit of U.S. Application No. 62/358,395, filed Jul. 5, 2016, which is incorporated herein by reference in its entirety.

BACKGROUND

The present disclosure relates generally to systems and methods for drilling a wellbore portion in a subterranean formation. The subterranean formation may be off shore, such as in a deepwater environment.

The production of hydrocarbons, i.e., oil and gas, from earth formations generally entails the drilling of one or more wells in the formation. Conventional well construction in open water (riserless sections) are often involves drilling the well in multiple stages or intervals. The following steps may be followed to construct a section of a well: a section of the wellbore is drilled, the drilling string is then removed from the well, a casing string is lowered into the wellbore, cement is pumped in the annulus between the casing string and the formation to secure the casing string in place, the drilling string is then placed back in the well, and the next section of the wellbore is drilled.

These aforementioned steps of drilling a well in an open water environment are recognized to be time consuming. The amount of time it takes to trip the drilling string in and out of the well is often in the range of from 4 hours to 24 hours.

The costs of performing such operations can vary from $200,000 to more than a $1,000,000. In addition, the tripping out of the drilling string can be problematic for a variety of reasons. For example, occasionally the exposed formations may begin to flow when the drilling string is being removed as this operation sucks the fluids into the new wellbore. As a result, the well may occasionally be lost. Furthermore, open water drilling typically involves a "pump and dump" technique, where drilling fluid used to drill the well is not recovered but instead lost. The costs of the lost drilling fluid may be in the range of from $2,000,000 to $4,000,000.

It is desirable to develop a method of drilling a subsea riserless well that does not require tripping the drilling string in and out of the wellbore.

SUMMARY

In one embodiment, the present disclosure provides a system comprising: a wellbore penetrating a subterranean formation; a casing string lining the wellbore; a drilling string disposed within the casing string; and a cement retainer disposed within the casing string.

The cement retainer may comprise and/or consist of a valve disposed within the casing string.

In another embodiment, the present disclosure provides a method comprising drilling a first portion of a wellbore with a drilling string disposed within a casing string and extending through a cement retainer disposed within the casing string.

BRIEF DESCRIPTION OF THE DRAWINGS

A more complete and thorough understanding of the present embodiments and advantages thereof may be acquired by referring to the following description taken in conjunction with the accompanying drawings.

FIGS. 1A-1C are illustrations of a drilling system in accordance with certain embodiments of the present disclosure.

FIGS. 2A-2C are illustrations of a drilling system in accordance with certain embodiments of the present disclosure.

The features and advantages of the present disclosure will be readily apparent to those skilled in the art. While numerous changes may be made by those skilled in the art, such changes are within the spirit of the disclosure.

DETAILED DESCRIPTION

The description that follows includes exemplary apparatuses, methods, techniques, and/or instruction sequences that embody techniques of the inventive subject matter. However, it is understood that the described embodiments may be practiced without these specific details.

The present disclosure relates generally to systems and methods of drilling a well. The systems and methods may be used for drilling a well in a deepwater environment. More specifically, the systems and methods may be used for drilling a well in a deepwater environment without the use of a riser or multiple trips. The systems and methods may be used for drilling a well with a riserless drilling system.

A section of a wellbore is drilled in a subterranean formation, using a drilling string disposed within a casing string and extending through a cement retainer disposed within the casing string. Some desirable attributes of the systems and methods discussed herein are that they may enable an operator to drill a section of a wellbore, install a casing string, and cement the casing string in place, without tripping out of the well. If necessary, once the cement is set, the operation may be continued by drilling a second section of the wellbore. A trip may be necessary prior to drilling of the second section of the wellbore, for example to replace the drill bit and other components, for drilling of smaller diameter versions. The methods and systems discussed herein may allow for a deepwater well to be drilled quicker and cheaper than conventions methods and system.

Figure 1A:
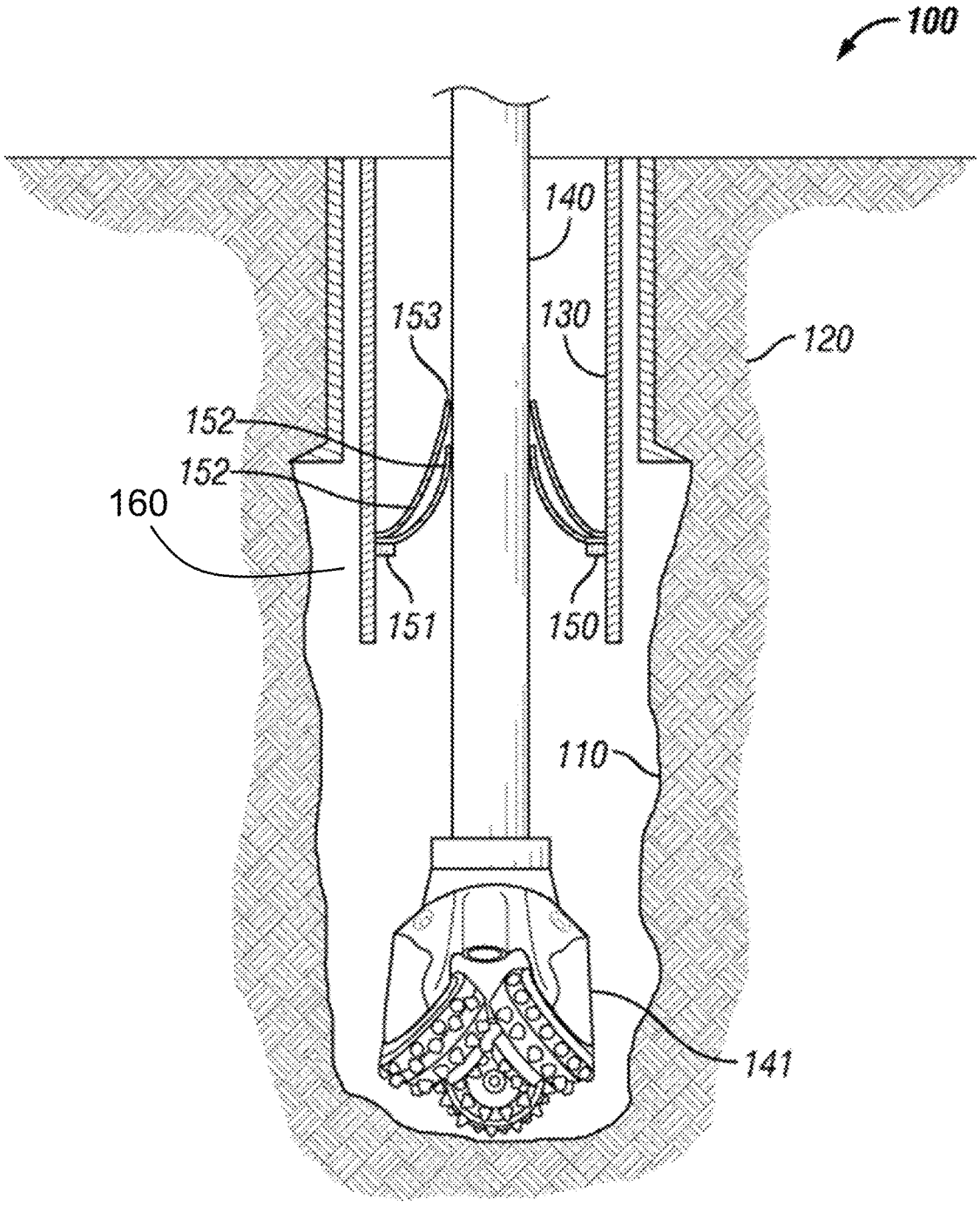
Figure 1B:
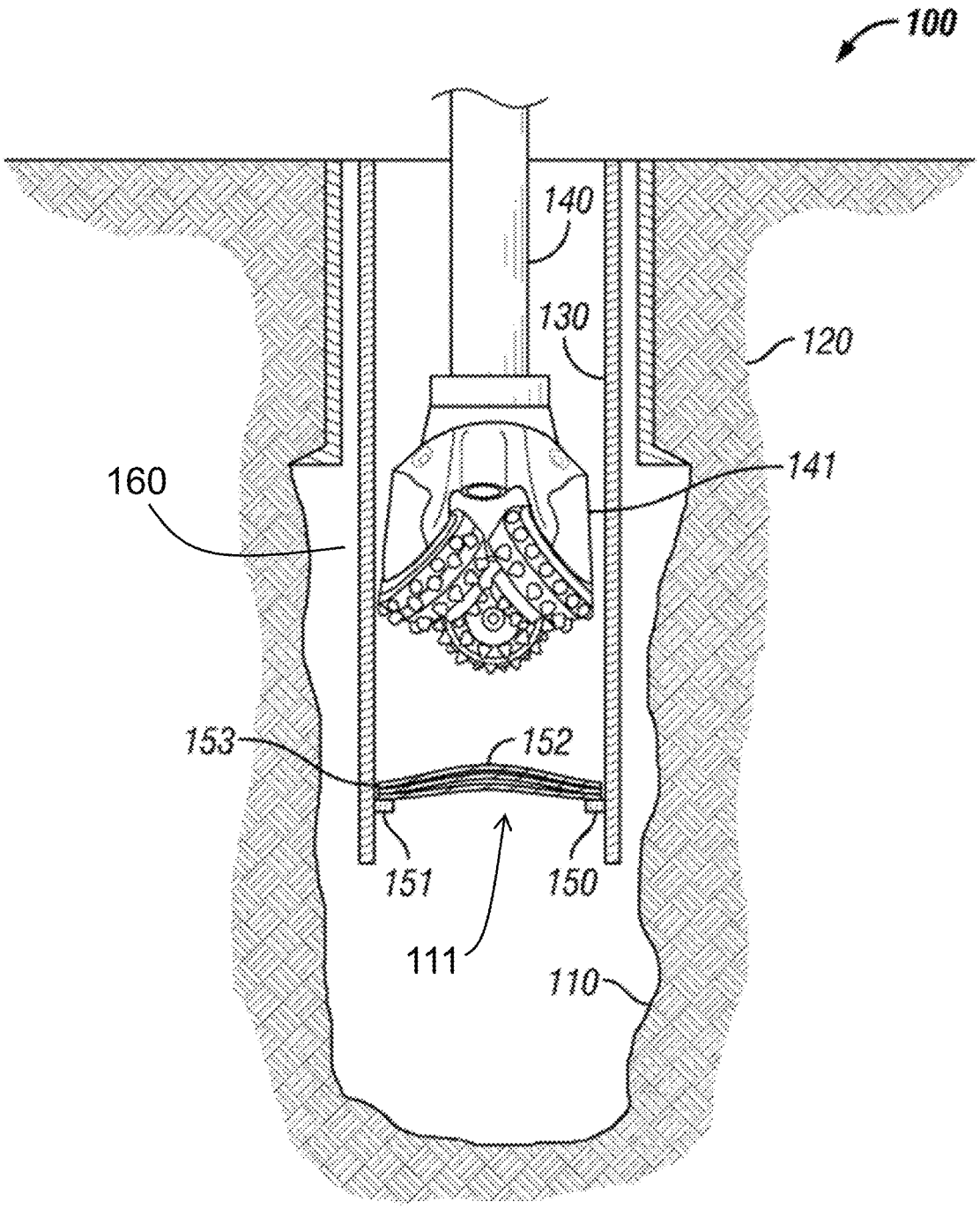

Referring now to FIGS. 1A-1C, FIG. 1A-1C illustrates well bore system 100. In certain embodiments, wellbore system 100 may comprise a wellbore 110 arranged in subterranean formation 120, a casing string 130, a drilling string 140, and a cement retainer 150. As illustrated, for example, in FIG. 1A, cement retainer 150 may be in a partially open configuration. In this case, the drilling string 140 may temporarily extend through the cement retainer 150. FIG. 1B shows an example where the cement retainer 150 is in a closed configuration. In the closed configuration, there is preferably no drilling string 140 extending through the cement retainer 150. Before commencing a cementing operation, for example, the drilling string 140 may be retracted to above the cement retainer 150, upon which the cement retainer 150 may transition from the partially open configuration to the closed configuration. In FIG. 1C, cement retainer 150 may have been drilled through.

The wellbore 110 may comprise any conventional type of wellbore penetrating a subterranean formation. The wellbore 110 may be an onshore or offshore wellbore. The wellbore 110 may optionally be a wellbore for a deepwater well.

The casing string 130 may line certain portions of the wellbore 110. Not all portions of the wellbore 110 need to be lined: some portions of wellbore 110 may not be lined by casing string 130. The casing string 130 may suitably comprise any conventional casing string used in deepwater or conventional wells.

The drilling string 140 may be disposed within casing string 130. The drilling string 140 may suitably comprise any conventional drilling string used in the construction of deepwater or conventional wells. A bottom hole assembly 141 may be attached to the end of drilling string 140. The bottom hole assembly 141 may suitably comprise any conventional bottom hole assembly used in the drilling of deepwater or conventional wells. Suitably, the bottom hole assembly comprises a drill bit. The drill bit may be of any type, including roller cone drill bits and passive cutter drill bits, such as for example PCD (poly-crystalline diamond) drill bits. In addition, an under reamer or a sidewinder (sometimes referred to as "sweep") may be provided, to allow drilling a wide enough hole for the casing string 130. Suitably, the bottom hole assembly may comprise a motor, such as a mud motor, to rotate the drill bit and the optional under reamer or sidewinder reamer.

As shown in FIG. 1A, drilling string 140 may pass through and/or around cement retainer 150. At times, drilling string 140 may be located above cement retainer 150, an example of which being shown in FIG. 1B.

In certain embodiments, cement retainer 150 may comprise one or more sheets 152. For example, the cement retainer 150 may comprise one, two, three, four, five, six, seven, eight, nine, or ten sheets 152. The cement retainer 150 may furthermore comprise a ring 151. Sheets 152 may be connected to ring 151. For example, sheets 152 may be built into ring 151, molded in place to ring 151, or attached by a fastner to ring 151. The ring 151 may comprise a solid ring. Ring 151 may define a cavity.

The ring 151 may have an inner diameter in the range of from 25 cm to 100 cm (10 inches to 40 inches). For example, ring 151 may have an inner diameter in the range of from 50 to 89 cm (20 inches to 35 inches), or in the range of from 35 to 94 cm (14 inches to 37 inches).

The ring 151 may have an outer diameter in the range of from 30 cm to 107 cm (12 inches to 42 inches). For example, ring 151 may have an outer diameter in the range of from 56 cm to 94 cm (22 inches to 37 inches), or in the range of from 38 cm to 97 cm (15 inches to 38 inches).

The ring 151 may have a height in the range of from 2.5 cm to 64 cm (1 inch to 25 inches). For example, ring 151 may have a height in the range of from 5 cm to 38 cm (2 inches to 15 inches), or in the range of from 13 cm to 25 cm (5 inches to 10 inches).

Ring 151 may be constructed out of any conventional material used in well operations. For example, ring 151 may be plastic. Ring 151 may for example be constructed of aluminum plastics, glass, and/or brass. Ring 151 may be drillable.

Ring 151 may be connected to an interior of the casing string 130. For example, ring 151 may be glued, welded, brazed, or riveted to the interior of casing string 130. Ring 151 may comprise an insert or a dedicated pup.

Sheets 152 may comprise flexible rubber sheets. Alternative or in addition thereto, sheets 152 may comprise flexible plastic or flexible metals.

The sheets 152 may have an outer diameter equal to the inner diameter of casing string 130 and/or the inner diameter of ring 151. Sheets 152 may have a thickness that provides enough flexibility so that drilling string 140 may pass through cement retainer 100 and enough structural strength so that cement retainer 100 remains closed a pressure gradient exists below cement retainer 100.

The sheets 152 may comprise a lip 153. Such lip 153 may allow sheets 152 to connect to the casing string 130.

The drilling string may at times pass through the cement retainer. At such times, the cement retainer is in a partially open position whereby one or more flexible elements (for example the sheets 152) of the cement retainer contact the drilling string. The presence of drilling string prevents cement retainer 150 from transitioning into a closed position. At such times, no seal is formed between the exterior of the casing string and the bore inside of the casing string.

When there is no drilling string passing through the cement retainer 150, the cement retainer may be in a closed position. A differential pressure may suitably allow the cement retainer to transition from the partially open position to the closed position or vice versa depending on the direction of the pressure gradient. In certain embodiments, the elastic property of the flexible elements in the cement retainer (such as the sheets 152) may allow the cement retainer to snap into the closed positon when drilling string is removed. In other embodiments, not illustrated in FIG. 1A or 1B, springs may be employed to supply the force required to snap the cement retainer into the closed position.

When there is no drilling string passing through the cement retainer 150, each of the sheets 152 may for instance fold into a downward overlapping position forming a seal on top of cavity 111. At such times, the u-tubing effect caused by cement that may have been pumped into annulus 160 defined by wellbore 110 and casing 130 can be prevented. The cement 135 may be allowed to harden, and thus cement casing 130 to wellbore 110.

Generally, as the casing string can be lowered into the wellbore together with the drilling string and contemporaneously to drilling the wellbore. When a target depth has been reached, the drilling string can subsequently be retracted to a position within the casing string above the cement retainer, the casing may be cemented without tripping the drilling string out of the wellbore. The drill bit is protected by the seal provided by the cement retainer, which prevents cement to flow upward back into the casing string.

In certain embodiments, such as illustrated in FIG. 1C, the cement retainer 150 may be drilled through. In such embodiments, drill string 140, or a different drilling string, may be used to drill through cement retainer 150 and to drill a further portion of wellbore 110.

In other embodiments, not illustrated in FIG. 1, cement retainer 150 may be in a fully open position whereby the one or more sheets 152 each contact casing string 130.

Figure 2A:
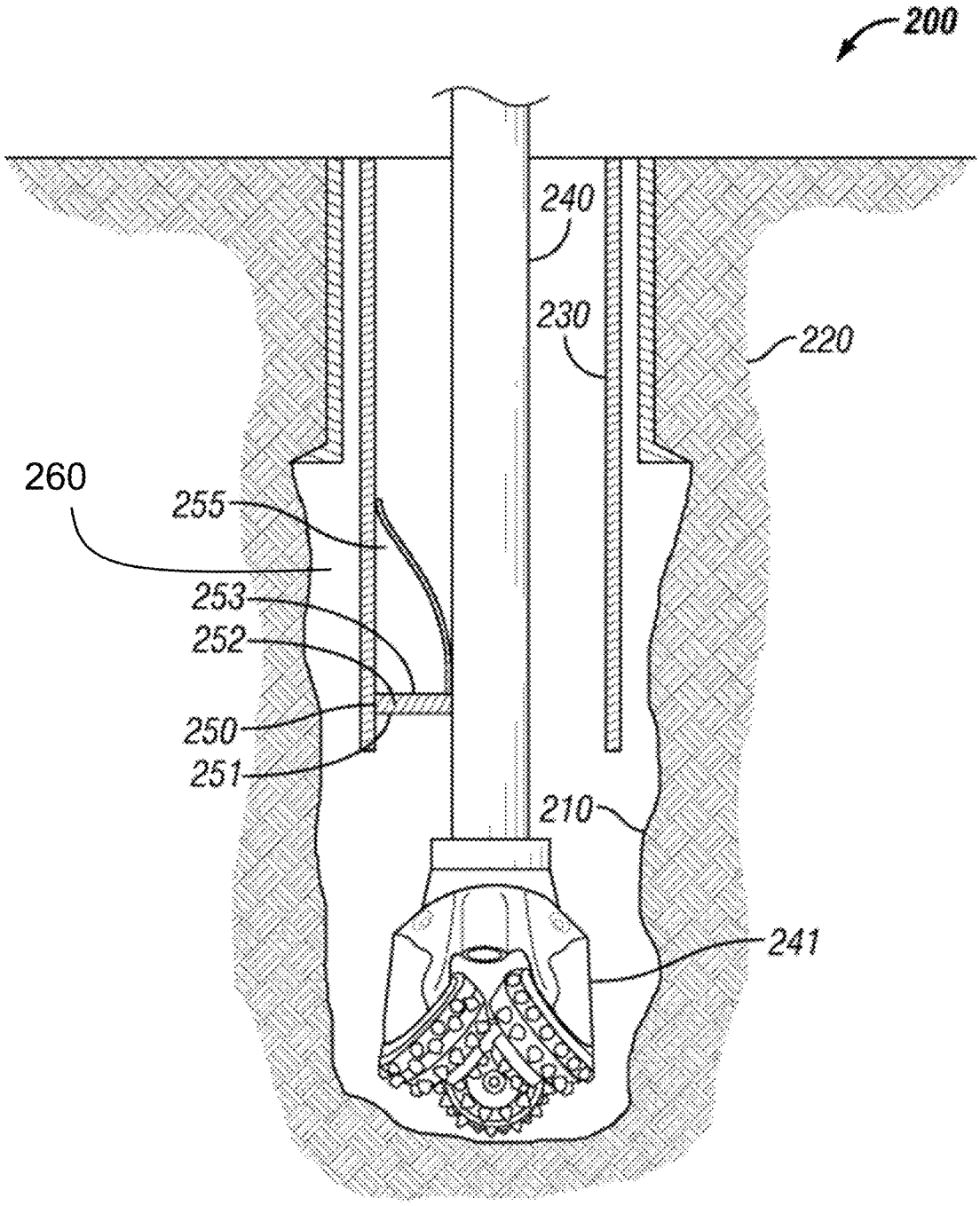
Figure 2B:
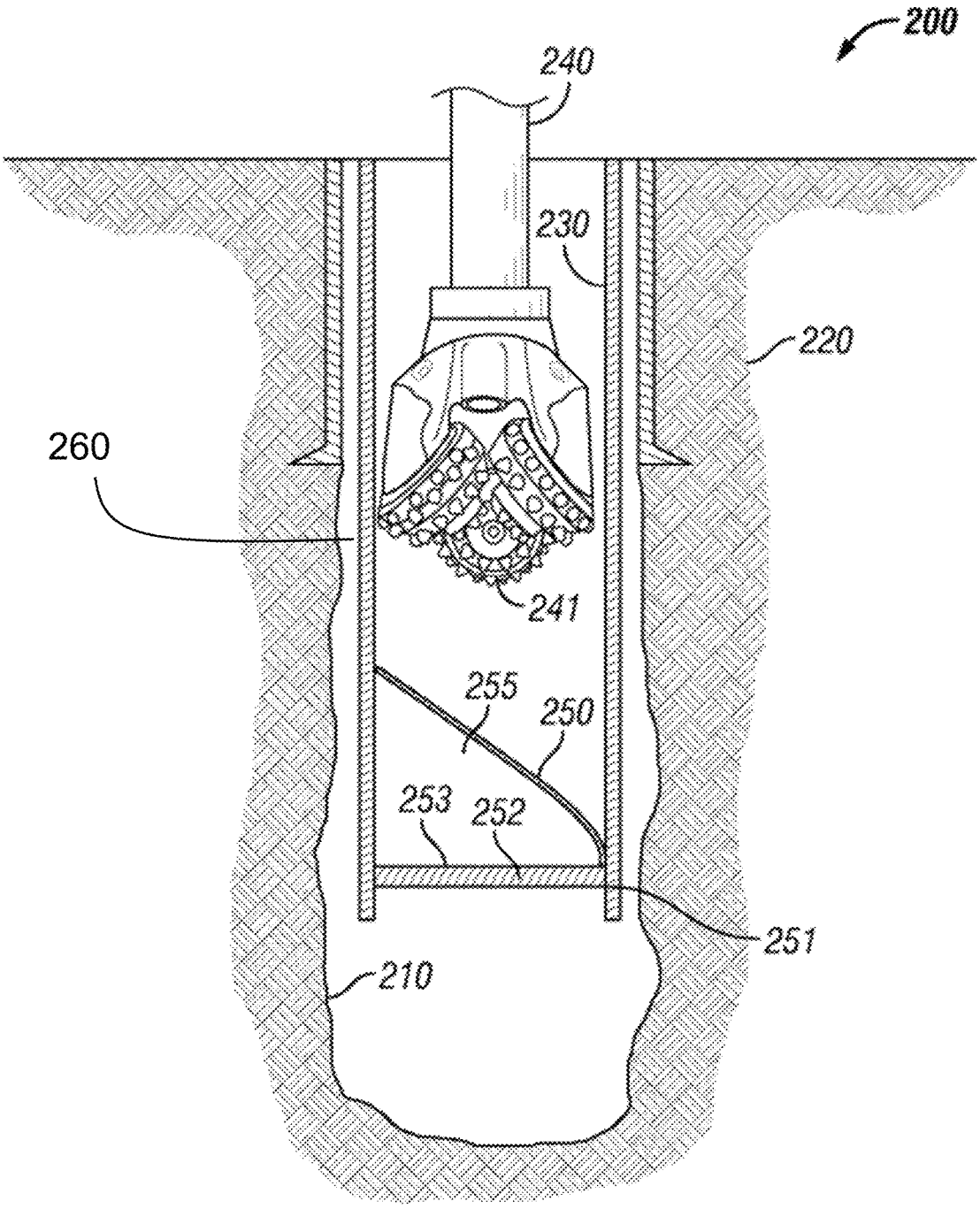

Referring now to FIGS. 2A-2C, FIGS. 2A-2C illustrate well bore system 200. The wellbore system 200 may comprise wellbore 210 in a subterranean formation 220, casing string 230, drilling string 240, and a cement retainer comprising a valve 250.

As illustrated in FIG. 2A, the valve 250 may be in a partially open configuration. At times, such as for example shown in FIG. 2B, the valve 250 may be in a closed configuration. In other embodiments, for example in FIG. 1C, valve 250 may have been drilled through.

One or more features of wellbore 210 may be combined with or replaced by one or features discussed above with respect to wellbore 110. For example, casing string 230 may comprise any combination of features discussed above with respect to casing string 130. Similarly, casing string 230 may line certain portions of wellbore 210. Certain portions of wellbore 210 may not be lined by casing string 230.

Drilling string 240 may be disposed within casing string 230. The drilling string 240 may comprise any combination of features discussed above with respect to drilling string 140. For example, a bottom hole assembly 241 may be attached to the end of drilling string 240. The bottom hole assembly 241 may comprise any combination of features discussed above with respect to bottom hole assembly 141.

As shown in FIG. 2A, drilling string 240 may pass though and/or around valve 250. In other embodiments, as shown in FIG. 2B, drilling string 240 may be located above valve 250. At times, drilling string 240 may be located above valve 250, an example of which being shown in FIG. 1B.

Valve 250 may be a one way inline check valve. Suitably, when inline check valve is in a closed position, the valve 250 may only transition to an open position when a higher pressure exists above valve 250. Suitably, the valve 250 prohibits flow of fluids upward into the casing string 230 and thus form a seal for upward flowing fluids. A flow of fluids downward to valve 250 may force valve 250 to transition into an open position. When inline check valve is in an open position valve 250 it may transition to the closed position when a higher pressure exists below valve 250. For example, a flow of fluids upward to valve 250 may force valve 250 to transition into the closed position.

The valve 250 may comprise base portion 251 and a tapered portion 255. In certain embodiments, base portion 251 and tapered portion 255 are capable of being temporarily deformed by the drilling string 240 passing through valve 250, and/or fluid pressing down on the valve 250. The base portion 251 may comprise a ring 252 and a top 253. Ring 252 may define a cavity. The valve 250 may generally have a cylindrical shape, with a cylindrical wall section around a central longitudinal axis, and whereby the ring 252 and base portion 251 form the lower end face, which is circular and oriented normal to and centralized on the longitudinal axis, and whereby the upper end face has an elliptical contour and is oriented at a cone angle thus forming the tapered portion. A projection of the upper end face on a plane normal to the longitudinal axis may yield a circular shape centered on point of intersection of the longitudinal axis with said plane.

The ring 252 (when valve 250 is in a closed position) may have an inner diameter in the range of from 25 cm to 100 cm (10 inches to 40 inches). For example, ring 252 (when valve 250 is in a closed positon) may have an inner diameter in the range of from 50 cm to 75 cm (20 inches to 30 inches). In certain embodiments, ring 252 (when valve 250 is in a closed position) may have an outer diameter in the range of from 25 cm to 100 cm (10 inches to 40 inches). For example, ring 252 (when valve 250 is in a closed position) may have an outer diameter in the range of from 50 cm to 75 cm (20 inches to 30 inches).

Ring 252 (when valve 250 is in a closed position) may have a height in the range of from 1 to 4 times the inner diameter of ring 252. In certain embodiments, ring 252 (when valve 250 is in a closed position) may have a height in the range of from 2.5 cm to 64 cm (1 inch to 25 inches). For example, ring 252 (when valve 250 is in a closed position) may have a height in the range of from 13 cm to 25 cm (5 inches to 10 inches).

The inner diameter, outer diameter, and height of ring 252 and the shape of base portion 251 may vary when valve 250 is in an open position, as shown in FIG. 2B. The top 253 may prevent the flow of fluids through valve 250 when valve 250 is in a closed position.

The base portion 251 may be constructed out of any conventional material used in well operations. For example, base portion 251 may be plastic. Base portion 251 may for example be constructed of aluminum, plastics, glass, and/or brass. Base portion 251 may be drillable.

Base portion 251 may be connected to an interior of casing string 230. For example base portion 251 may be glued, welded, brazed, or riveted to the interior of casing string 230. Base portion 251 may comprise an insert or a dedicated pup.

The tapered portion 255 may comprise any flexible material. For example, tapered portion 255 may be constructed of plastic, rubber, or sealed canvas.

Tapered portion 255 may be sized to fit the inner diameter of casing string 230. In certain embodiments, tapered portion 255 may be tapered to a cone angle degree in the range of from 30 degrees to 60 degrees. For example, tapered portion 255 may be tapered to a cone angle degree in the range of 30 to 30 degrees, or in the range of from 40 to 60 degrees. In certain embodiments, tapered portion 255 may be tapered to a 45-degree cone angle.

The tapered portion 255 may be connected to base 251. Valve 250 may be a formed out of a single piece of material.

As shown in FIG. 2A, drilling string 240 may pass around and/or through valve 250. At such times, valve 250 is in the partially open position, whereby base 251 may for example be deformed and not in contact with an entire circumference of casing string 230. The presence of drilling string 240 may prevents valve 250 from transitioning into the closed position. At such times, valve 250 does not form a seal across casing string 230.

When there is no drilling string passing through valve 250, the valve 250 may be in a closed position. In that position, base 251 may contact an entire circumference of casing string 230 thereby forming a seal. At such times, cement 235 that may have been pumped into annulus 260 defined by wellbore 210 and casing 230, may be prevented to flow back into the into the casing string 230 by the u-tubing effect. The cement 235 may be allowed to harden, and thus cement casing 230 to wellbore 210. The casing may thus be cemented without tripping drilling string 240 out of the wellbore.

In certain embodiments, as shown in FIG. 1C, valve 250 may be drilled through. In such embodiments, drill string 240 or another drill string may be used to drill through valve 250 and to drill a further portion of wellbore 210.

Thus, a method is provided comprising: drilling a first portion of a wellbore with a drilling string disposed within a casing string and extending through a cement retainer disposed within the casing string; retracting the drilling string into the casing string to fully above the cement retainer; and cementing the casing string in the first portion of the wellbore. The drilling string may be pulled up through the cement retainer before cementing the casing string in the wellbore. The method may be performed without removing the drilling string from the wellbore.

In certain embodiments, the wellbore may comprise any combination of features discussed above with respect to wellbore 110 and/or wellbore 210. In certain embodiments, the wellbore may penetrate a subterranean formation. In certain embodiments, the subterranean formation may comprise any combination of features discussed above with respect to subterranean formation 120 and/or subterranean formation 220.

In certain embodiments, the drilling string may comprise any combination of features discussed above with respect to drilling string 140 and/or drilling string 240. In certain embodiments, a bottom hole assembly may be attached to the end of the drilling string. In certain embodiments, the bottom hole assembly may comprise any combination of features discussed above with respect to bottom hole assembly 141 and/or bottom hole assembly 241.

The cement retainer may comprise any combination of features discussed above with respect to cement retainer 150 and/or valve 250. The cement retainer (valve) may be placed in the casing string before the casing string is placed in the wellbore. Alternatively, the cement retainer (valve) may be placed in the casing string after the casing string has been placed in the wellbore. The cement retainer (valve) may be placed in the casing string in a closed position. Alternatively, the cement retainer (valve) may be placed in the casing string in an open or partially open position.

The drilling string and/or bottom hole assembly may pass down through and/or around the cement retainer (valve) during drilling of the first or second portion of the wellbore. The cement retainer (valve) may be in a partially open position while drilling the first or second portion of the wellbore.

The drilling string and/or bottom hole assembly may be may pulled up above the cement retainer (valve) after the drilling the first or second portion of the wellbore. The cement retainer may transition to a closed position after the drilling string and/or bottom hole assembly is pulled up above the cement retainer (valve). Subsequently the casing string may be cemented in the wellbore whereby maintaining the drilling string inside the casing in the first or second portion of the wellbore.

The method may further comprise pumping cement into the annulus defined by the wellbore and the casing string. Suitably, the cement may be pumped into the annulus while the cement retainer (valve) is in a closed position. The cement may be prevented from flowing up the casing string by the cement retainer (valve) while pumping the cement into the annulus. The method may further comprise allowing the cement to set.

Alternatively, the cement may be pumped into the annulus through the drill string being in retracted position above the cement retainer (valve). The differential pressure downward will temporarily cause the cement retainer (valve) to open. After a sufficient amount of cement has been pumped into the annulus, some drilling mud may be pumped to clean out the drilling string and flush any remaining cement from the casing string. The cement may be prevented from flowing back into and up the casing string by the cement retainer (valve) before hardening. The method may further comprise allowing the cement to set.

The method may further comprise drilling through the cement retainer (valve). This may be done subsequently to injecting and preferably subsequently to hardening of the cement. The method may further comprise drilling a second or third portion of the wellbore.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

That which is claimed is:

1. A system comprising:

a wellbore penetrating a subterranean formation;

a casing string lining the wellbore whereby an annulus is defined between the wellbore and the casing string;

a drilling string disposed within the casing string; and a bottom hole assembly attached to an end of the drilling string, wherein the bottom hole assembly comprises a drill bit;

a cement retainer disposed within the casing string, wherein the drilling string is extendable through the cement retainer and retractable to a retracted position within the casing string and above the cement retainer; and unhardened cement disposed in the annulus while maintaining the drilling string and the drill bit within the casing string protected by a seal provided by the cement retainer which prevents cement from flowing upward back into the casing string, wherein the drilling string is in the retracted position within the casing string.

2. The system of claim 1, wherein the cement retainer comprises a valve.

3. The system of claim 1, wherein the cement retainer comprises a base portion and a tapered portion.

4. The system of claim 1, wherein the cement retainer comprises a ring.

5. The system of claim 1, wherein the cement retainer comprises a ring and one or more sheets connected to the ring.

6. The system of claim 5, wherein each of the one or more sheets comprises a lip that is attachable to the casing string.

7. The system of claim 1, wherein the cement retainer is capable of transitioning from a partially open position to a closed position when the drilling string is pulled up through it.

8. A method comprising:

drilling a first portion of a wellbore with a drilling string disposed within a casing string and extending through a cement retainer disposed within the casing string, whereby a bottom hole assembly is attached to an end of the drilling string and comprises a drill bit;

retracting the drilling string into the casing string to be above the cement retainer before cementing the casing string in the wellbore; and cementing the casing string in the first portion of the wellbore whereby maintaining the drilling string and the drill bit inside the casing string protected by a seal provided by the cement retainer which prevents cement from flowing upward back into the casing string.

9. The method of claim 8 further comprising pulling the drilling string up through the cement retainer before cementing the casing string in the wellbore.

10. The method of claim 8, further comprising drilling a second portion of the wellbore after cementing the casing in the wellbore.

* * * * *